United States Patent [19]

Schaeflern et al.

[11] 4,403,561

[45] Sep. 13, 1983

[54] PRESSER BAR SPRING-CONNECTION

[75] Inventors: Henry Schaeflern, Pittstown; Jan Szostak, Lincroft, both of N.J.

[73] Assignee: The Singer Company, Stamford, Conn.

[21] Appl. No.: 323,773

[22] Filed: Nov. 23, 1981

[51] Int. Cl.[3] ..... D05B 29/02

[52] U.S. Cl. ..... 112/237; 267/179

[58] Field of Search ..... 267/179, 70; 403/146, 403/137, 166; 112/235, 237; 24/216, 218, 155 C, 256, 261

[56] References Cited

U.S. PATENT DOCUMENTS

| | | | |
|---|---|---|---|
| 289,687 | 12/1883 | Morris . | |
| 373,851 | 11/1887 | Post . | |
| 413,149 | 10/1889 | Rexer et al. | 24/256 |
| 460,955 | 10/1891 | Diehl . | |
| 1,221,138 | 4/1917 | Chadwick . | |
| 1,664,647 | 4/1928 | Sundstrand | 267/179 X |
| 2,355,700 | 8/1944 | Blewett . | |
| 2,392,730 | 1/1946 | Enos . | |
| 2,422,820 | 6/1947 | Best . | |
| 2,743,690 | 5/1956 | Mayer . | |
| 2,754,783 | 7/1956 | Scott et al. . | |
| 3,055,326 | 9/1962 | Greulich . | |
| 3,093,101 | 6/1963 | Foltis et al. . | |
| 3,303,804 | 2/1967 | Lesort . | |
| 3,433,193 | 3/1969 | Takahashi . | |
| 3,669,050 | 6/1972 | Adams . | |
| 4,323,024 | 4/1982 | Jones et al. | 112/237 |

FOREIGN PATENT DOCUMENTS

| | | | |
|---|---|---|---|
| 68283 | 1/1949 | Denmark | 24/256 |
| 617087 | 6/1934 | Fed. Rep. of Germany | 267/179 |
| 52-141755 | 5/1977 | Japan . | |
| 652246 | 3/1979 | U.S.S.R. . | |
| 763620 | 9/1980 | U.S.S.R. | 24/256 |

OTHER PUBLICATIONS

U.S. patent appln. Ser. No. 081,404—Filed 10/3/79—Transue et al.

U.S. patent appln. Ser. No. 141,879—Filed 4/21/80—Jones.

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

An axially aligned presser bar collar and presser bar bushing in a sewing machine are connected by a helical spring having one end portion affixed to the collar and having the opposite end portion threaded onto a resilient split ring which is located in an annular groove in the bushing.

8 Claims, 4 Drawing Figures

PRESSER BAR SPRING-CONNECTION

DESCRIPTION

BACKGROUND OF THE INVENTION

1. Field of the Invention

The invention relates to means for connecting a fixed member and a movable member in axial alignment therewith through a helical spring. More particularly, the invention is directed to means for connecting a presser bar bushing and presser bar attached collar in a sewing machine through a helical spring surrounding the presser bar.

2. Description of the Prior Art

It is known in sewing machines to urge a presser bar downwardly with a stretched helical spring having an upper end operably connected to a presser bar attached member and having the lower end held against upward movement. preferably, the spring and presser bar are coaxially arranged to permit the spring force to be applied along the axis of the presser bar. Such an arrangement is disclosed in copending patent application Ser. No. 081,404 of James A. Transue and William Weisz for "Extension Spring Biasing Structure" filed Oct. 3, 1979, and in copending patent application Ser. No. 141,879, U.S. Pat. No. 4,323,024 of Gary D. Jones et al for "Simplified Presser Bar" filed Apr. 21, 1980. Opposite ends of the spring may be connected to a presser bar attached member and a spring holding member coaxial therewith by threading end coils of the spring into machined helical grooves in such members as disclosed in the said patent applications. The connections made in such fashion serve their intended purpose, however, it is a costly operation to machine helical grooves in the members to receive coils of the spring.

It is a prime object of the present invention to provide the means for connecting axial aligned members with a coaxial helical spring in a manner permitting the connection to be made without the need for machined helical grooves to receive coils of the spring and requiring only the utilization of an inexpensive readily available split ring.

Other objects and advantages of the invention will become apparent during a reading of the specification taken in connection with the accompanying drawings.

SUMMARY OF THE INVENTION

In accordance with the invention, a helical spring and a cylindrical member are connected coaxially by threading coils at one end of the spring into a split resilient ring which is located in a groove in the cylindrical member and projects outwardly therefrom beyond a portion of the surface of said member on each side of the groove. Such surface portion is preferably tapered on one side of the groove extending to the end of the member so as to permit the spring to be easily slipped over the end of the member. The diameter of said surface portion on the other side of the groove is preferably slightly greater than the relaxed inside diameter of the spring to provide for a tight fit between the member and the end of the spring. A difference in the diameters of the surface portion on said other side of the groove and the main body of the member provides a stop for the end of the spring. The spring attaches at the end opposite from said cylindrical member to another member to permit relative movement of the members.

DESCRIPTION OF THE PREFERRED EMBODIMENT

Figure 1:
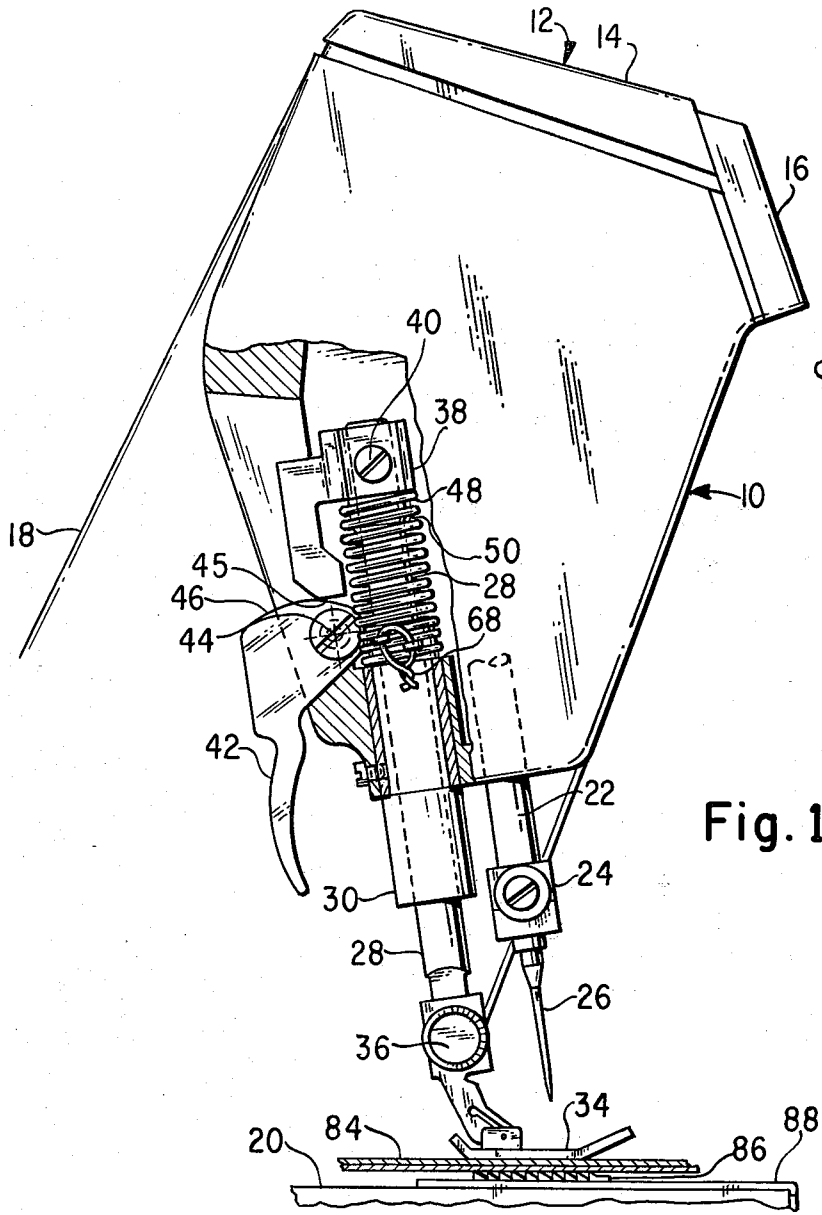
FIG. 1 is an end view of a sewing machine showing the arrangement of the invention on a released presser bar.

Referring to the drawings, reference character 10 designates the head end portion of a sewing machine depending from an arm 12 of which only the surfaces 14 and 16 are visible as edges in FIG. 1. A standard 18 extending upwardly from the bed 20 of the machine supports the arm. A needle bar 22 is mounted for endwise movement in the head end portion of the sewing machine in the customary way and has a clamp 24 at its lower end to hold a needle 26.

A presser bar 28 is also supported in the sewing head where it extends through a bushing 30 which as shown is secured in the head by a screw 32. Over most of the length of the bushing its inner surface 25 has a larger diameter than the external cylindrical surface of the presser bar 28. However, the bushing is formed with short regions 27 and 29 having an inner diameter just enough larger than the outer diameter of the presser bar 28 to allow a smooth sliding fit between the presser bar and these regions which serve as journals for the presser bar. A presser foot 34 is attached to the lower end of the presser bar 28 at 36, and a collar 38 is affixed to the upper end of the presser bar by a screw 40. A presser bar lifting lever 42 is pivoted in the head 10 of the sewing machine about an axis at 44. The lever 42 is formed with a cam 46 which impinges upon the shoulder 45 of a depending portion 47 of collar 38.

A helical coil spring 48 is provided to urge the presser bar 28 downwardly in the head. The spring is disposed to extend between collar 38 and bushing 30 in coaxial alignment with the presser bar 28. The spring is shown attached at one end to the upper end of bushing 30 in accordance with the invention, and at the opposite end to a depending boss 50 on collar 38 in a manner as disclosed in U.S. patent application Ser. No. 141,879 mentioned hereinbefore.

Figure 3:
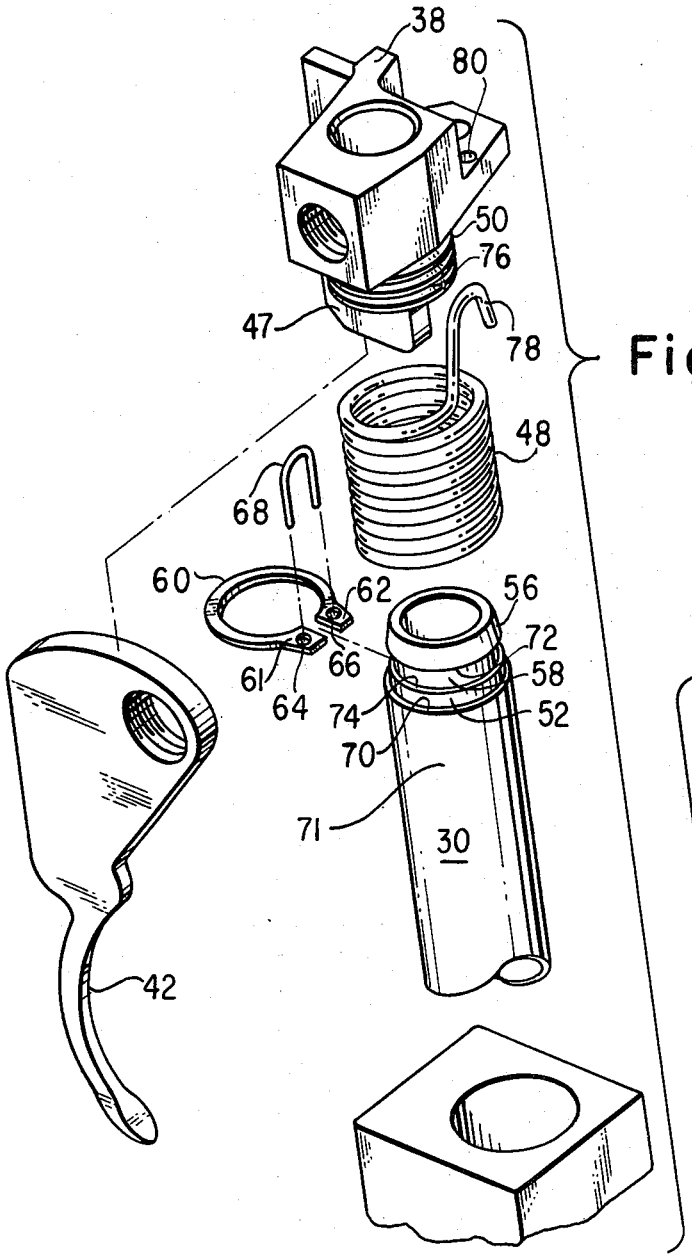
FIG. 3 is an enlarged disassembled exploded perspective view showing the structure of the invention.
Figure 4:
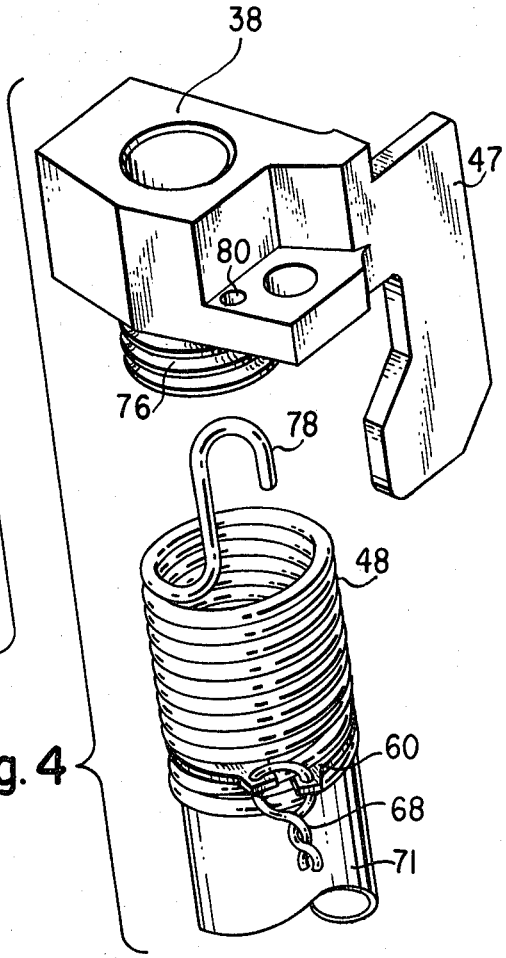
FIG. 4 is an enlarged partially disassembled view showing the structure of the invention.

The upper end of bushing 30 (see FIG. 3) includes a portion 52 having a diameter which is less than the diameter of the main body of the part, but slightly greater than the inside diameter of the spring in its relaxed condition. An extreme upper end portion 56 of the bushing is tapered for easy movement into the spring. Bushing portions 52 and 56 are separated by an annular groove 58 wherein a flat resilient split retaining ring 60 is received. The inside diameter of the ring substantially corresponds to the diameter of the bushing 30 at the bottom of groove 58, and the outside diameter of the ring exceeds the diameters of bushing portions 52 and 56. Enlarged end portions 61 and 62 of the ring include through openings 64 and 66 respectively for a tying wire 68.

Bushing 30 with the ring 60 then in groove 58 is attached at its upper end to spring 48 by first inserting extreme end portion 56 of the bushing into the spring. The enlarged end portions 61 and 62 of the ring, and extreme end coils of the spring are then spread axially as required to permit the end coil of the spring to be threaded into the resulting axial gap between the separated end portions 61 and 62 of the ring. The spring and ring are threaded into each other by relative turning thereof until the end of the spring is caused to abut ledge 70 separating bushing portion 52 from the main body 71 of the bushing between the ends thereof. Tying wire 68 is then inserted through holes 64 and 66 in the ring and twisted to prevent expansion and subsequent dislogment of the ring from groove 58. During the threading process, end coils of the spring are slightly expanded onto bushing portion 52 and caused to tightly grip its surface. The width of groove 58 is such as to cause end portions 61 and 62 of the ring in the threaded position to engage opposite sides 72 and 74, respectively of the groove.

As shown, depending boss 50 on collar 38 is provided with threads 76 which are engaged by the upper end coils of spring 48 screwed thereon. An end portion 78 of the spring 48 is anchored in hole 80 in the collar 38. The boss 50 and upper end coils of the spring could also be connected in the manner described for the bushing 30 and the lower end of the spring coils, that is by having a groove formed in the boss and a ring in the groove threaded into the coils of the spring.

Presser bar lifting lever 42 is shown in a down position in FIG. 1. The spring 48 is in tension acting through collar 38 to pull the presser bar 28 downwardly and cause foot 34 to be pressed against material 84 to be sewn. The material is engaged from below by a feed dog 86 that extends up through a throat plate 88 in the bed 20. In the down position of the lifting lever 42 a camming surface 46 on the lever is engaged by shoulder 45 on depending portion 47 of collar 38.

Figure 2:
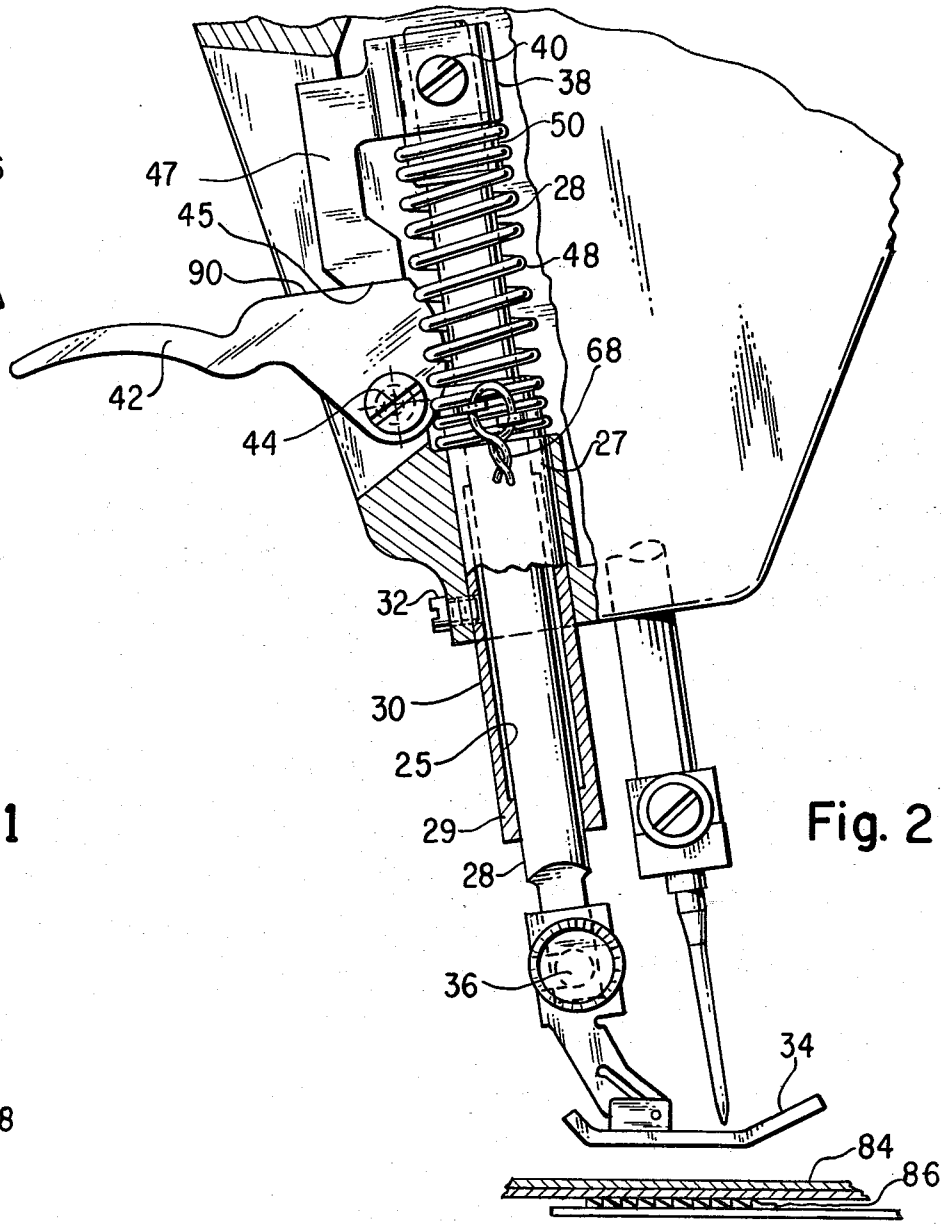
FIG. 2 is a fragmentary enlarged end view generally similar to FIG. 1 but showing the presser bar lifted.

The presser bar 28 is moved upwardly to lift the presser foot 34 off the material 84 by clockwise rotation of the lever 42 about its pivotal axis at 44. Camming surface 41 on the lever moves the collar 38 and thereby the presser bar 28 upwardly until shoulder 48 rests upon a flat 90 on the lever (see FIG. 2). In the process, spring 48 is extended and energy is stored therein. When the lifting lever is rotated in a counterclockwise direction the stored energy in the spring serves to move the presser bar downwardly and restore the presser foot to its position against material 84.

It is to be understood that the present invention relates to a preferred embodiment of the invention which is for purposes of illustration only and that various changes and modifications therein without departing from the spirit and scope of the invention as defined in the appended claims.

We claim:

1. In combination, two axially aligned members mounted for relative axial movement, at least one of the members including an annular groove, a split resilient ring located in said groove and projecting outwardly from opposite side surfaces of the groove, a helical spring having one end portion threaded into the ring which is constrained thereby to enforce engagement of opposite side surfaces of the ring with the opposite side surfaces of the groove and so prevent relative axial movement of the said one end portion of the spring and the grooved member, and means connecting an opposite end portion of the spring to said other member.

2. The combination of claim 1 wherein said one member is a stationary member and the other member is movable.

3. The combination of claim 2 wherein the stationary member is a bushing and the movable member is slidable therein.

4. The combination of claim 1 wherein said one member includes a cylindrical portion about which end coils of the spring extend and which has a diameter greater than the internal relaxed diameter of the spring.

5. The combination of claim 1 including means for tying ends of the split ring together to prevent dislodgement of the ring from said groove.

6. The combination of claim 1 wherein ends of the split ring are wired together to prevent dislodgement of the ring from said groove.

7. The combination of claim 1 wherein the connecting means includes helical grooves into which the said opposite end portion of the spring is threaded.

8. The combination of claim 1 wherein said one member is a stationary presser bar bushing in a sewing machine and said other member is a movable presser bar slidable in the bushing.

* * * * *